US008944863B1

(12) United States Patent
Yang

(10) Patent No.: US 8,944,863 B1
(45) Date of Patent: Feb. 3, 2015

(54) TERMINAL SET OF ELECTRICAL CONNECTOR

(71) Applicant: All Best Precision Technology Co., Ltd., Taoyuan County (TW)

(72) Inventor: Haven Yang, New Taipei (TW)

(73) Assignee: All Best Precision Technology Co., Ltd., Taoyuan County (TW)

( * ) Notice: Subject to any disclaimer, the term of this patent is extended or adjusted under 35 U.S.C. 154(b) by 0 days.

(21) Appl. No.: 13/951,760

(22) Filed: Jul. 26, 2013

(51) Int. Cl.
*H01R 13/02* (2006.01)
*H01R 13/6585* (2011.01)

(52) U.S. Cl.
CPC ..... *H01R 13/6585* (2013.01)
USPC ..... 439/884; 439/733.1; 439/607.08

(58) Field of Classification Search
CPC ..... H01R 23/7073; H01R 13/65802; H01R 23/005
USPC ..... 439/108, 607.8, 733.1, 884, 660, 320, 439/607.08
See application file for complete search history.

(56) References Cited

U.S. PATENT DOCUMENTS

| | | | | |
|---|---|---|---|---|
| 5,151,036 | A * | 9/1992 | Fusselman et al. | 439/108 |
| 6,280,209 | B1 * | 8/2001 | Bassler et al. | 439/101 |
| 6,457,983 | B1 * | 10/2002 | Bassler et al. | 439/101 |
| 7,303,410 | B2 * | 12/2007 | Saito | 439/108 |
| 7,458,829 | B2 * | 12/2008 | Shioda et al. | 439/108 |
| 7,604,510 | B2 * | 10/2009 | Akama et al. | 439/637 |
| 7,674,118 | B2 * | 3/2010 | He | 439/108 |
| 7,682,192 | B2 * | 3/2010 | Sawdy et al. | 439/607.05 |
| 7,833,068 | B2 * | 11/2010 | Bright et al. | 439/733.1 |
| 8,047,875 | B2 * | 11/2011 | Yamakami et al. | 439/660 |
| 8,167,631 | B2 * | 5/2012 | Ito et al. | 439/108 |
| 8,376,783 | B2 * | 2/2013 | Kondo et al. | 439/660 |
| 8,449,322 | B2 * | 5/2013 | Cai | 439/541.5 |
| 2004/0242071 | A1 * | 12/2004 | Ito et al. | 439/608 |

* cited by examiner

*Primary Examiner* — Briggitte R Hammond
(74) *Attorney, Agent, or Firm* — WPAT, P.C.; Anthony King

(57) ABSTRACT

A terminal set of an electrical connector includes signal terminal duos and ground terminal duos. The signal terminal duos have two signal terminals. The signal terminals are spaced apart transversely. The ground terminal duos have two ground terminals. The signal terminal duos are disposed between the ground terminals. The ground terminals are each spaced apart transversely from an adjacent one of the signal terminals. The ground terminals are each larger than and hide transversely an adjacent one of the signal terminals. The terminal set functions as a shield for precluding crosstalk from taking place between terminals and precluding resonance from taking place between terminals.

5 Claims, 9 Drawing Sheets

TERMINAL SET OF ELECTRICAL CONNECTOR

FIELD OF THE INVENTION

The present invention relates to terminal sets of an electrical connector, and more particularly, to a terminal set of an electrical connector, wherein the terminal set functions as a shield for precluding crosstalk from taking place between terminals and precluding resonance from taking place between terminals.

BACKGROUND OF THE INVENTION

Due to technological advancement, manufacturers nowadays have tasks, such as observation, control, measurement and recording, performed by means of advanced electronic apparatuses during a manufacturing process. The electronic apparatuses are each equipped with at least an electrical connector for connecting the electronic apparatuses and transmitting data therebetween. Conventional terminals of an electrical connector are capable of electrical connection and electronic signal transmission but incapable of precluding crosstalk from taking place between terminals. Furthermore, resonance often occurs between the conventional terminals of an electrical connector.

Accordingly, it is imperative to provide a terminal set of an electrical connector, wherein the terminal set functions as a shield for precluding crosstalk from taking place between terminals and precluding resonance from taking place between terminals.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a terminal set of an electrical connector as disclosed in the present invention with a view to precluding crosstalk from taking place between terminals and precluding resonance from taking place between terminals.

In order to achieve the above and other objectives, the present invention provides a terminal set of an electrical connector, comprising: signal terminal duos having two signal terminals, the signal terminals being spaced apart transversely, the signal terminals are V-shaped each; and ground terminal duos having two ground terminals flanking the signal terminal duos, the ground terminals each being spaced apart transversely from, being larger than, and hiding transversely an adjacent one of the signal terminals, the ground terminals are V-shaped each, wherein the ground terminals have a smaller transverse width than the signal terminals and are plate-like each.

As regards the terminal set of an electrical connector, the signal terminals each comprise a first electrical connection portion and a first fixing portion, the first fixing portion being of an "embedded and fixed" style, wherein the ground terminals each comprise a second electrical connection portion and a second fixing portion, the second fixing portion being of an inserted-style and extending to form an inserted portion running parallel to the second electrical connection portion.

As regards the terminal set of an electrical connector, the first electrical connection portions are spaced apart transversely by a first distance and are each spaced apart transversely from an adjacent one of the second electrical connection portions by a second distance. The first distance is shorter than the second distance.

As regards the terminal set of an electrical connector, the first fixing portions each have two recesses facing an adjacent one of the first fixing portions and an adjacent one of the second fixing portions, respectively, and bottoms of the recesses adjacent to and facing each other are spaced apart transversely by a third distance. The second fixing portions are each spaced apart transversely from an adjacent one of the bottoms of the recesses by a fourth distance. The third distance is smaller than the fourth distance.

As regards the terminal set of an electrical connector, the front end of the first electrical connection portion and the front end of the second electrical connection portion have curved electrical connection structures, respectively.

As regards the terminal set of an electrical connector, the end of the first fixing portion and the end of the second fixing portion either face away from or face the first electrical connection portion and the second electrical connection portion, respectively, to thereby extend to form fixing structures, respectively.

Accordingly, the present invention provides a terminal set of an electrical connector with a view to precluding crosstalk from taking place between terminals and precluding resonance from taking place between terminals.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
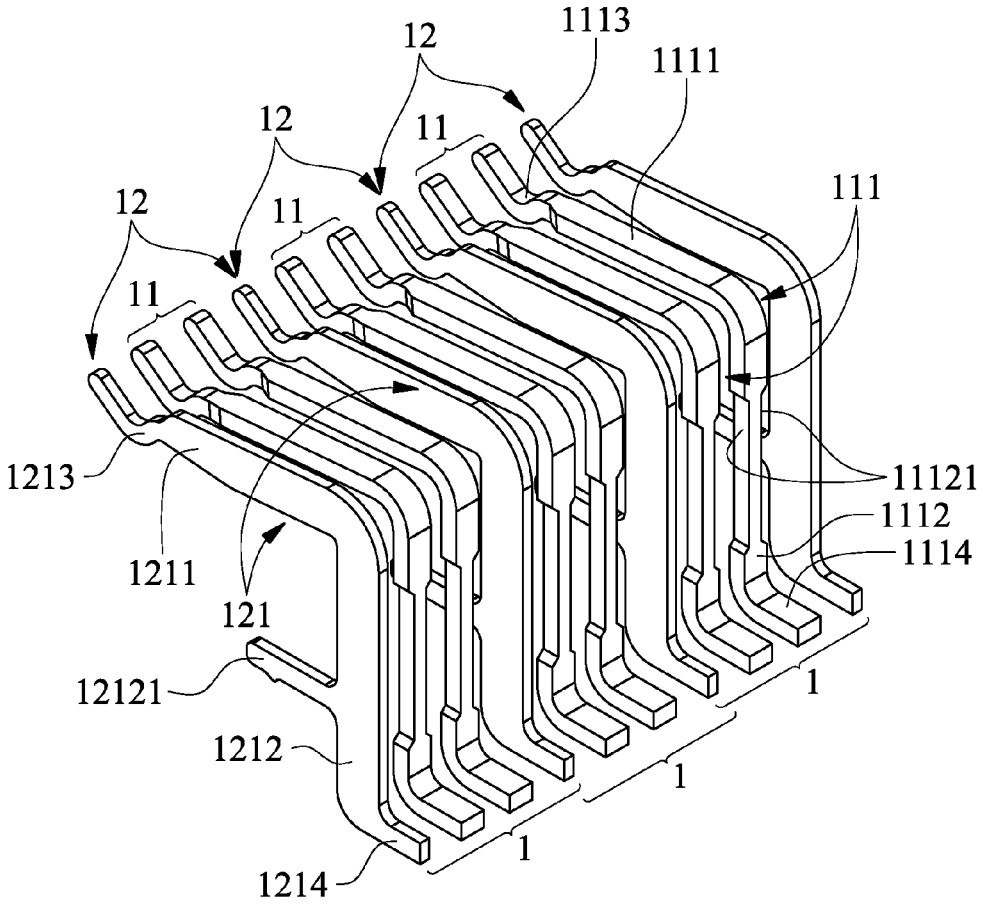
FIG. 1 is a perspective view of a terminal set of an electrical connector according to the specific embodiment of the present invention.

The present invention relates to terminals of an electrical connector and the application of the terminals of an electrical connector, wherein, in practice, the terminals come in the form of upper and lower terminals; hence, the present invention is directed to the upper and lower terminals of an electrical connector. For the sake of brevity, the present invention is hereunder exemplified by and illustrated with the upper terminals of an electrical connector. Referring to FIG. 1 through FIG. 6, in an embodiment of the present invention, a terminal set 1 of an electrical connector comprises signal terminal duos 11 and ground terminal duos 12. The signal terminal duos 11 have two signal terminals 111. The signal terminals 111 are parallel and transversely spaced apart. The signal terminals 111 each are V-shaped. The ground terminal duos 12 have two ground terminals 121. The signal terminal duos 11 are disposed between the ground terminals 121. The ground terminals 121 are each parallel to and transversely spaced apart an adjacent one of the signal terminals 111. The ground terminals 121 each are V-shaped. As shown in FIG. 1 through FIG. 4, the signal terminals 111 are each hidden by an adjacent one of the ground terminals 121 transversely and completely for two reasons: first, the ground terminals 121 are each larger than an adjacent one of the signal terminals 111 (as, specifically speaking, the main surface area (shown in FIG. 4) of each ground terminal 121 is larger than that of the adjacent signal terminal 111); and, second, the ground terminals 121 and the signal terminals 111 are arranged in a specific manner (shown in FIGS. 2, 3) that the ground terminals 121 each hide an adjacent one of the signal terminals 111 transversely and completely. As shown in FIG. 1, FIG. 2, FIG. 3, FIG. 5 and FIG. 6, the transverse width (i.e., the maximum width) of the ground terminals 121 is less than the transverse width (i.e., the maximum width) of the signal terminals 111, and the ground terminals 121 are each plate-like. Accordingly, the plate-like ground terminals 121 are inserted into the slots 31 of the stand 3, respectively, and thus clamped at the slots 31; hence, the ground terminals 121 cannot rotate relative to the stand 3 and thus are fixed in place.

Accordingly, the terminal set 1 of an electrical connector is characterized in that the ground terminals 121 are each larger than an adjacent one of the signal terminals 111, and that the ground terminals 121 each hide an adjacent one of the signal terminals 111 transversely, so as to preclude crosstalk from taking place between terminals. Furthermore, referring to FIG. 1, the terminal set 1 of an electrical connector in the embodiment of the present invention is provided in plurality as needed.

Referring to FIG. 1, FIG. 4, FIG. 5, and FIG. 6, the signal terminals 111 each comprise a first electrical connection portion 1111 and a first fixing portion 1112. The first fixing portion 1112 is of an "embedded and fixed" style. The lower end of the first fixing portion 1112 is either connected and fixed to, or soldered and fixed to, a circuit board or any other electrical structure (not shown) so as to transmit an electronic signal. The included angle between the first electrical connection portion 1111 and the first fixing portion 1112 is an acute angle, an obtuse angle, or a right angle. The front end of the first electrical connection portion 1111 is in electrical connection (or contact) with a terminal of an inserted component (not shown) so as to transmit an electronic signal. Furthermore, the signal terminals 111 manifest resilience; hence, as soon as the terminal of the inserted component comes into electrical connection (or contact) with the first electrical connection portion 1111, the terminal of the inserted component pushes the front end of the first electrical connection portion 1111 upward; meanwhile, the first electrical connection portion 1111 exerts a downward resilient restoring force on the terminal of the inserted component to make sure that the first electrical connection portion 1111 is in electrical connection (or contact) with the terminal of the inserted component. Furthermore, the ground terminals 121 each comprise a second electrical connection portion 1211 and a second fixing portion 1212 which form the two legs of the V-shaped configuration of each said ground terminal 121, respectively. The second fixing portion 1212 is of an inserted-style and extends longitudinally to form an inserted portion 12121 running parallel to the second electrical connection portion 1211. The lower end of the second fixing portion 1212 is either connected and fixed to, or soldered and fixed to, a circuit board or any other electrical structure (not shown) so as to transmit an electronic signal. The included angle between the second electrical connection portion 1211 and the second fixing portion 1212 is an acute angle, an obtuse angle, or a right angle. The front end of the second electrical connection portion 1211 is in electrical connection (or contact) with a terminal of an inserted component (not shown) so as to transmit an electronic signal. Furthermore, the ground terminals 121 manifest resilience; hence, as soon as the terminal of the inserted component comes into electrical connection (or contact) with the second electrical connection portion 1211, the terminal of the inserted component pushes the front end of the second electrical connection portion 1211 upward; meanwhile, the second electrical connection portion 1211 exerts a downward resilient restoring force on the terminal of the inserted component to make sure that the second electrical connection portion 1211 is in electrical connection (or contact) with the terminal of the inserted component.

Accordingly, due to the first fixing portions 1112 each of which is of an "embedded and fixed" style, the signal terminals 111 of the terminal set 1 of an electrical connector are coupled to a stand 3 in an "embedded and ejected" manner, whereas the ground terminals 121 are inserted into slots 31 of the stand 3, respectively, and then the inserted portions 12121 penetrate the stand 3 in order to be coupled to the stand 3.

Figure 3:
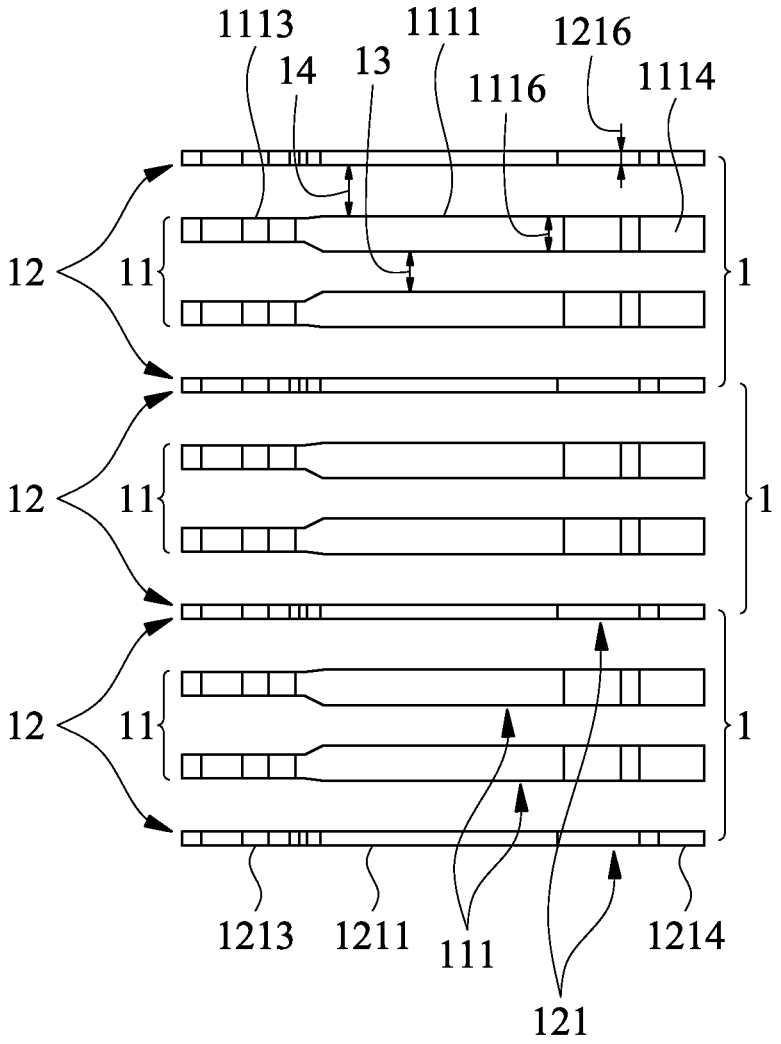
FIG. 3 is a top view of the terminal set shown in FIG. 1.
Figure 4:
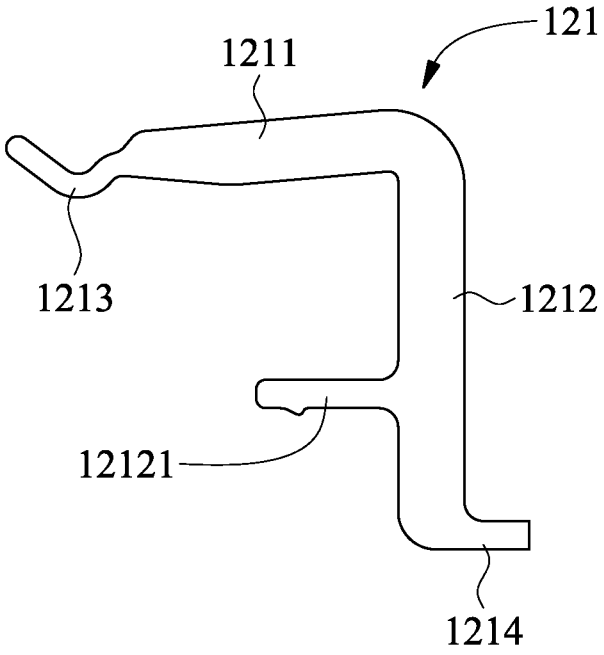
FIG. 4 is a schematic view of the terminal set viewed transversely.

Referring to FIG. 1 and FIG. 3, the first electrical connection portions 1111 are spaced apart transversely by a first distance 13 (i.e., the shortest distance between the first electrical connection portions 1111), whereas the first electrical connection portions 1111 are each spaced apart transversely from an adjacent one of the second electrical connection portions 1211 by a second distance 14 (i.e., the shortest distance between the first electrical connection portion 1111 and the second electrical connection portion 1211 adjacent thereto,) wherein the first distance 13 is shorter than the second distance 14. Accordingly, the terminal set 1 of an electrical connector precludes resonance from taking place between terminals.

Figure 2:
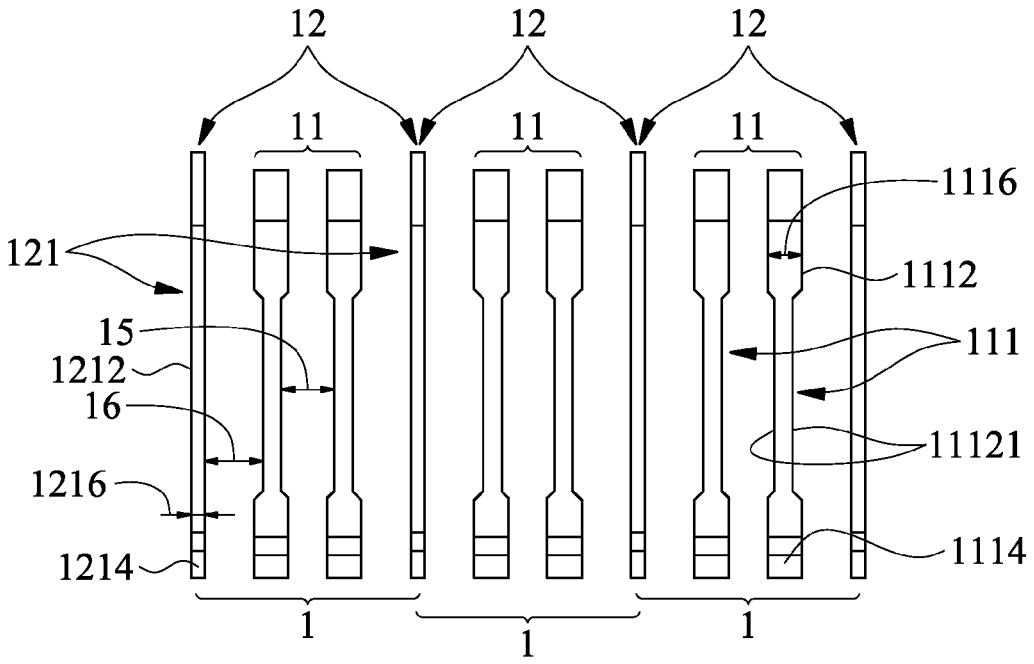
FIG. 2 is a schematic view of the terminal set viewed longitudinally.

Referring to FIG. 1 and FIG. 2, the first fixing portions 1112 each have two recesses 11121 facing an adjacent one of the first fixing portions 1112 and an adjacent one of the second fixing portions 1212, respectively. The bottoms of the recesses 11121 adjacent to and facing each other are spaced apart transversely by a third distance 15. The second fixing portions 1212 are each spaced apart transversely from an adjacent one of the bottoms of the recesses 11121 by a fourth distance 16, wherein the third distance 15 is shorter than the fourth distance 16. Accordingly, the terminal set 1 of an electrical connector precludes resonance from taking place between terminals.

Figure 5:
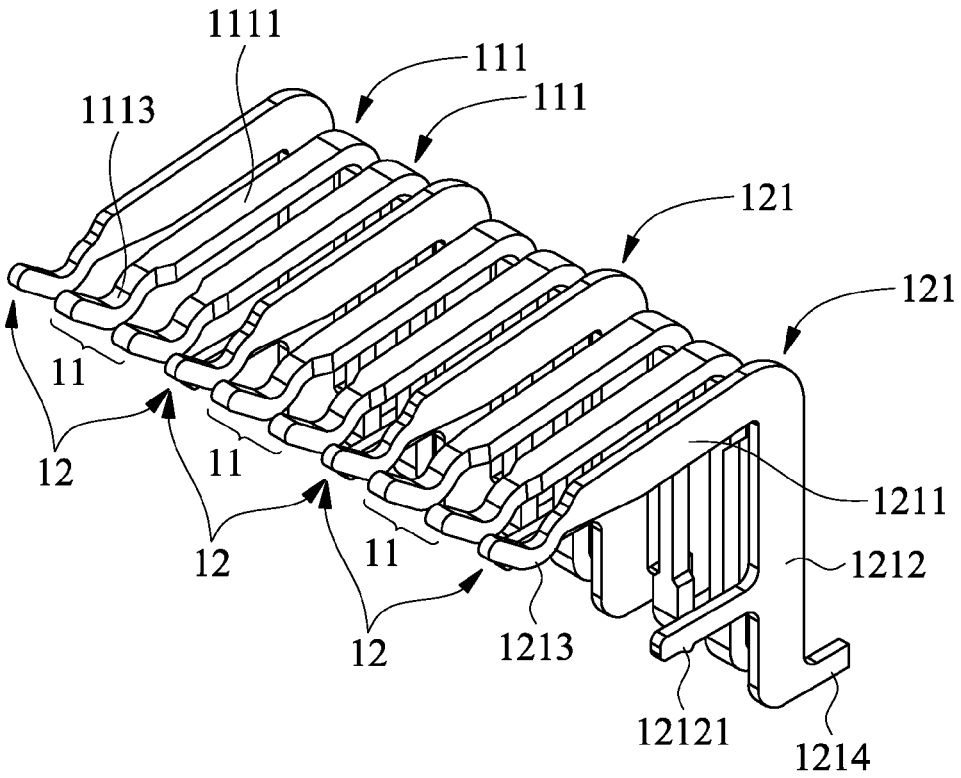
FIG. 5 is a perspective view of the terminal set viewed from an angle different from that of FIG. 1.
Figure 6:
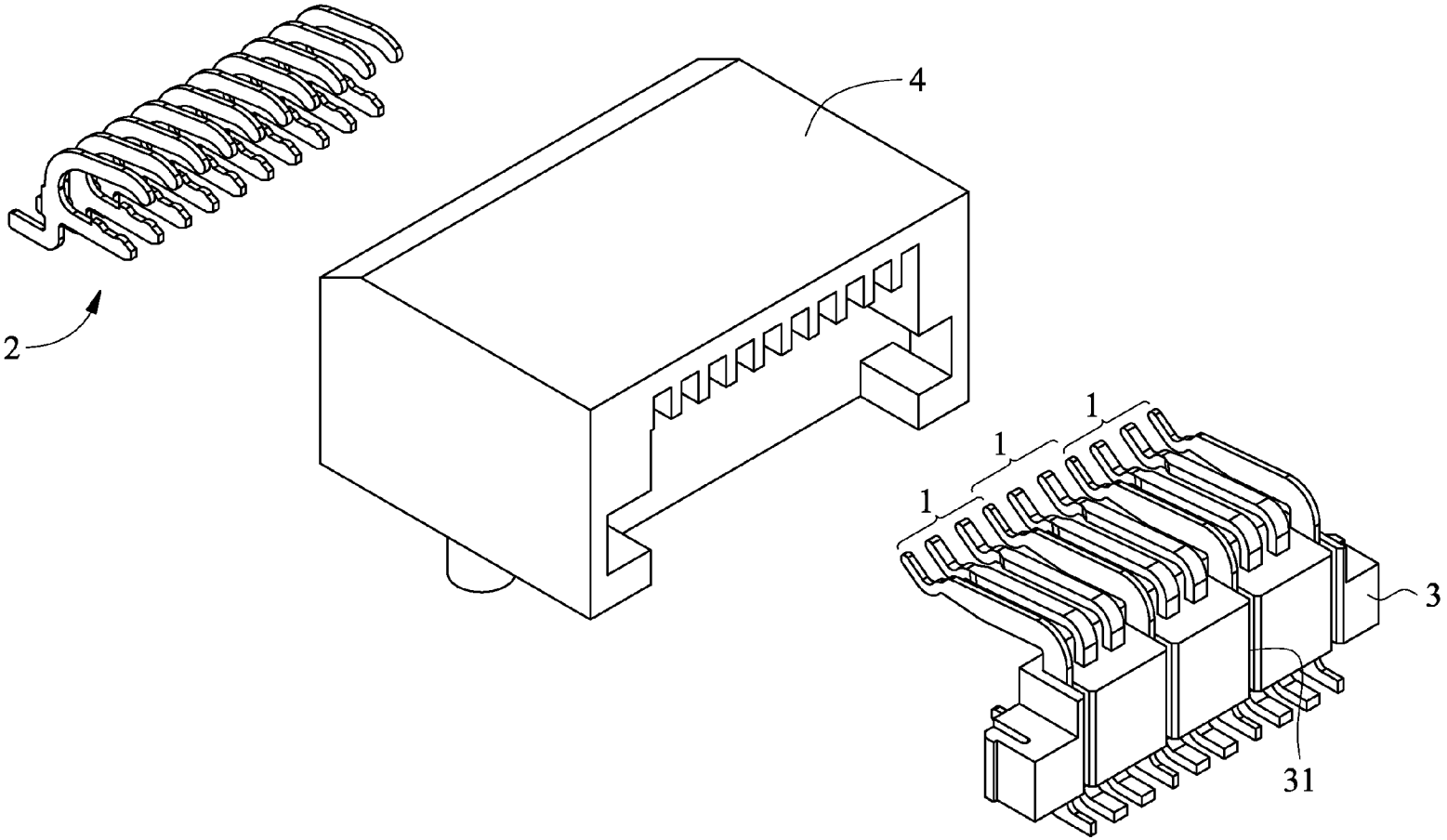
FIG. 6 is an exploded view that shows that the terminal set is coupled to a stand but separated from a lower terminal set and a casing according to the specific embodiment of the present invention.
Figure 7:
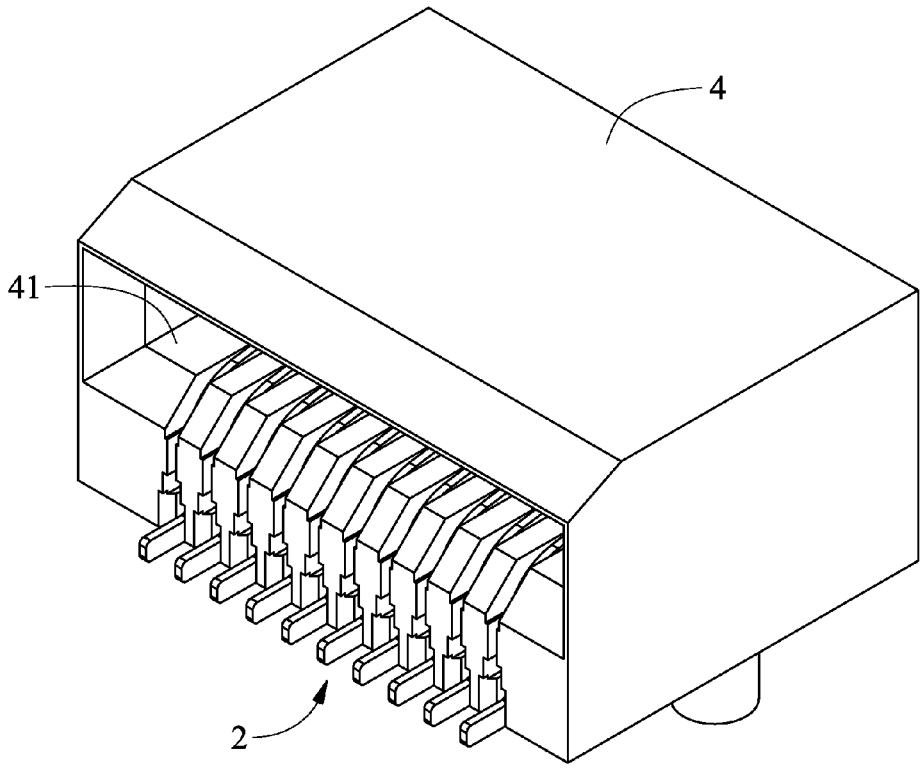
FIG. 7 is a perspective view that shows that the terminal set, the stand, the lower terminal set, and the casing are put together according to the specific embodiment of the present invention.
Figure 8:
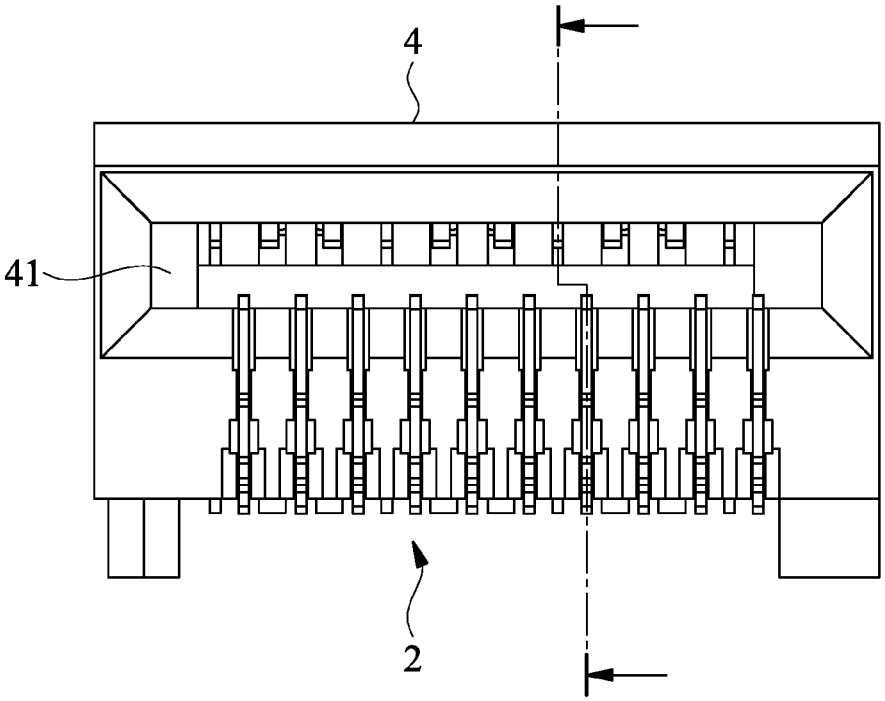
FIG. 8 is a schematic view of the terminal set shown in FIG. 7 and viewed transversely in FIG. 8.
Figure 9:
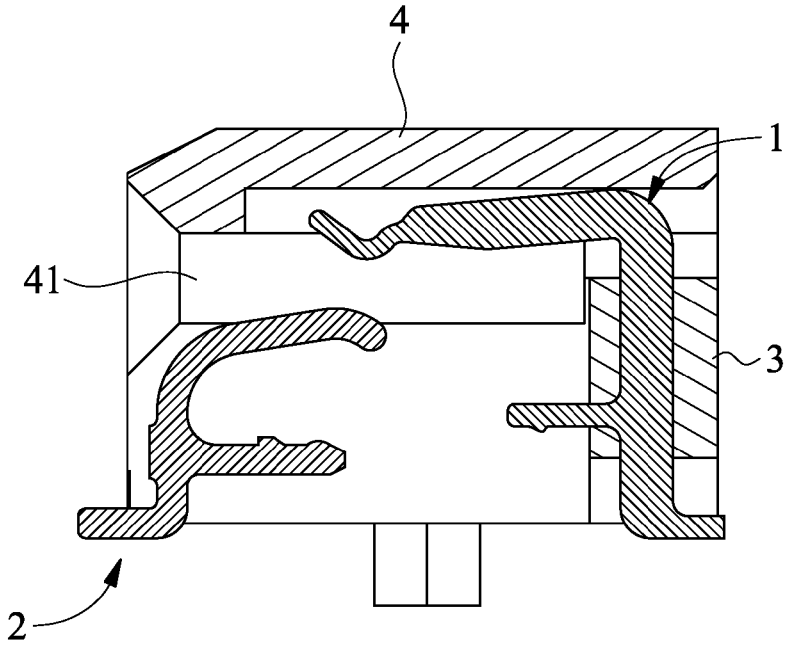
FIG. 9 is a cross-sectional view of the terminal set of FIG. 8.

Referring to FIG. 1 and FIG. 5, the front end of the first electrical connection portion 1111 and the front end the second electrical connection portion 1211 are provided with curved electrical connection structures 1113, 1213, respectively. The terminal of the inserted component (not shown) moves horizontally toward the first fixing portion 1112 and the second fixing portion 1212 and pushes the front end of the first electrical connection portion 1111 and the front end of the second electrical connection portion 1211 upward, such that the terminal of the inserted component pushes the front end of the first electrical connection portion 1111 and the front end of the second electrical connection portion 1211 upward, smoothly, easily and in a wear-reducing manner by means of the smooth lower edges of the curved electrical connection structures 1113, 1213.

Referring to FIG. 1 and FIG. 5, the lower end of the first fixing portion 1112 and the lower end of the second fixing portion 1212 either face away from or face the first electrical connection portion 1111 and the second electrical connection portion 1211, respectively, to thereby extend horizontally to form fixing structures 1114, 1214, respectively. Due to the fixing structures 1114, 1214, the lower end of the first fixing portion 1112 and the lower end of the second fixing portion 1212 have a larger fixation area whereby the lower end of the first fixing portion 1112 and the lower end of the second fixing portion 1212 are either connected and fixed to, or soldered and fixed to, a circuit board or any other electrical structure (not shown), thereby enhancing fixation.

Referring to FIG. 6 through FIG. 9, the signal terminals 111 of the terminal set 1 of an electrical connector are coupled to the stand 3 in an "embedded and ejected" manner, whereas the ground terminals 121 are inserted into the stand 3, respectively, and then the terminal set 1 of an electrical connector and a lower terminal set 2 are coupled together before being coupled to a casing 4. Then, the terminal of the inserted component (not shown) penetrates a slot 41 of the casing 4 before being electrically connected to the terminal set 1 and the lower terminal set 2. Furthermore, Referring to FIG. 1 and FIG. 6, once the terminal set 1 of an electrical connector and the stand 3 are coupled together, the recesses 11121 of the signal terminals 111 and the inserted portions 12121 of the ground terminals 121 enable the signal terminals 111, the ground terminals 121, and the stand 3 to be snap-engaged together, thereby enhancing fixation.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A terminal set of an electrical connector, comprising:

signal terminal duos having two signal terminals, the signal terminals being spaced apart transversely, wherein the signal terminals are V-shaped each having a first electrical connection portion and a first fixing portion, and one end of the first electrical connection portion connects to one end of the first fixing portion; and ground terminal duos having two ground terminals flanking the signal terminal duos, the ground terminals each being spaced apart transversely from, being larger than, and hiding transversely an adjacent one of the signal terminals, wherein the ground terminals are V-shaped each having a second electrical connection portion and a second fixing portion, one end of the second electrical connection portion connects to one end of the second fixing portion, the ground terminals have a smaller transverse width than the signal terminals and are plate-like each, and the first electrical connection portions are spaced apart transversely by a first distance and are each spaced apart transversely from an adjacent one of the second electrical connection portions by a second distance, with the first distance being shorter than the second distance.

2. The terminal set of an electrical connector according to claim 1, wherein the second fixing portion extends to form an inserted portion running parallel to the second electrical connection portion.

3. The terminal set of an electrical connector according to claim 1, wherein the first fixing portions each has two recesses facing an adjacent one of the first fixing portions and an adjacent one of the second fixing portions, respectively, and bottoms of the recesses adjacent to and facing each other are spaced apart transversely by a third distance, wherein the second fixing portions are each spaced apart transversely from an adjacent one of the bottoms of the recesses by a fourth distance, with the third distance being smaller than the fourth distance.

4. The terminal set of an electrical connector according to claim 1, wherein a front end of the first electrical connection portion and a front end of the second electrical connection portion have curved electrical connection structures, respectively.

5. The terminal set of an electrical connector according to claim 1, wherein an end of the first fixing portion and an end of the second fixing portion either faces away from or faces the first electrical connection portion and the second electrical connection portion, respectively, to thereby extend to form fixing structures, respectively.

* * * * *